US008402897B2

(12) United States Patent
O'Dwyer et al.

(10) Patent No.: US 8,402,897 B2
(45) Date of Patent: Mar. 26, 2013

(54) PROJECTILES WITH SEALED PROPELLANT

(75) Inventors: James Michael O'Dwyer, Brisbane (AU); Sean Patrick O'Dwyer, Norman Park (AU)

(73) Assignee: Metal Storm Limited, Darra (AU)

( * ) Notice: Subject to any disclaimer, the term of this patent is extended or adjusted under 35 U.S.C. 154(b) by 86 days.

(21) Appl. No.: 12/346,600

(22) Filed: Dec. 30, 2008

(65) Prior Publication Data

US 2009/0241795 A1 Oct. 1, 2009

Related U.S. Application Data

(62) Division of application No. 10/545,206, filed as application No. PCT/AU2004/000141 on Feb. 10, 2004, now Pat. No. 7,475,636.

(30) Foreign Application Priority Data

Feb. 10, 2003 (AU) ..... 2003900572
May 2, 2003 (AU) ..... 2003902103
May 23, 2003 (AU) ..... 2003902556

(51) Int. Cl.
*F42B 15/00* (2006.01)
*F42B 30/08* (2006.01)

(52) U.S. Cl. ..... 102/517; 102/438; 102/439; 102/380

(58) Field of Classification Search ..... 102/438, 102/439, 380, 501, 517, 217
See application file for complete search history.

(56) References Cited

U.S. PATENT DOCUMENTS 1,447,023 A 2/1923 Kaiser
2,099,993 A 11/1937 Tauschek
2,897,757 A 8/1959 Kulluck
3,139,795 A 7/1964 Altschuler
3,283,719 A 11/1966 Grandy
3,421,244 A 1/1969 Reed
3,427,924 A 2/1969 Johnsen
3,621,781 A 11/1971 Johnsen
3,815,271 A 6/1974 Lynn
3,854,231 A 12/1974 Broyles
3,877,381 A * 4/1975 McCoy ..... 102/501
4,285,153 A 8/1981 Crouch
4,807,532 A 2/1989 Andersson et al.
4,930,421 A 6/1990 Macdonald
5,880,397 A 3/1999 Crilly (Continued)

FOREIGN PATENT DOCUMENTS

DE 208577 2/1921
DE 2752844 8/1982

(Continued)

OTHER PUBLICATIONS

International Search Report, PCT/AU/2004/000141, 6 pages.

(Continued)

*Primary Examiner* — James Bergin

(74) *Attorney, Agent, or Firm* — Blakely Sokoloff Taylor & Zafman LLP

(57) ABSTRACT

Projectiles with sealed propellant are described herein. In one embodiment of the invention, a projectile includes a chamber having a propellant charger, an exit from the chamber for release of propellant gases into a barrel when the propellant is ignited to fire the projectile, and a seal to block the exit which is opened by ignition of the propellant within the chamber but is resistant to ignition of other propellant in the barrel, where the seal is carried from the barrel by the projectile after the ignition. Other methods and apparatuses are also described.

15 Claims, 20 Drawing Sheets

U.S. PATENT DOCUMENTS

| | | | | |
|---|---|---|---|---|
| 5,883,329 | A * | 3/1999 | O'Dwyer | 102/217 |
| 5,886,289 | A | 3/1999 | Nixon et al. | |
| 6,142,056 | A | 11/2000 | Talcyarkhan | |
| 6,715,398 | B2 | 4/2004 | O'Dwyer | |
| 6,779,461 | B1 | 8/2004 | Olson et al. | |
| 6,862,996 | B2 | 3/2005 | Key | |
| 7,194,943 | B2 * | 3/2007 | O'Dwyer | 89/28.05 |
| 7,373,884 | B2 | 5/2008 | Haeselich | |
| 7,475,636 | B2 * | 1/2009 | O'Dwyer et al. | 102/438 |
| 2002/0134226 | A1 | 9/2002 | O'Dwyer | |
| 2007/0068414 | A1 | 3/2007 | O'Dwyer | |
| 2011/0146522 | A1 * | 6/2011 | Wonsewitz | 102/438 |

FOREIGN PATENT DOCUMENTS

| | | |
|---|---|---|
| DE | 4035325 | 5/1992 |
| DE | 102004002471 | 8/2005 |
| FR | 2278052 | 2/1976 |
| FR | 2792399 | 10/2000 |
| GB | 253867 | 4/1926 |
| GB | 1594686 | 8/1981 |
| WO | WO 98/55824 | 12/1998 |
| WO | WO 00/62005 | 10/2000 |
| WO | WO 01/90680 | 11/2001 |
| WO | WO 02/097357 | 12/2002 |
| WO | WO 03/006917 | 1/2003 |
| WO | WO 03/023309 | 3/2003 |
| WO | WO 03/004443 | 5/2003 |
| WO | WO 03/089871 | 10/2003 |
| WO | WO 2004/001326 | 12/2003 |
| WO | WO 2004/070307 | 8/2004 |
| WO | WO 2004/097326 | 11/2004 |
| WO | WO 2004/102108 | 11/2004 |

OTHER PUBLICATIONS

International Search Report, PCT/AU2007/000184, 5 pages.

* cited by examiner

PROJECTILES WITH SEALED PROPELLANT

RELATED APPLICATIONS

This application is a divisional application of a U.S. patent application Ser. No. 10/545,206, filed Jun. 16, 2006, now U.S. Pat. No. 7,475,636, which is a national phase application of International Application No. PCT/AU2004/000141, filed Feb. 10, 2004, which claims the priority from Australian Patent Application Nos.: 2003900572 filed Feb. 10, 2003; 2003902103 filed May 2, 2003; and 2003902556 filed May 23, 2003. The disclosures of the above-identified applications are incorporated by reference herein in their entirety.

FIELD OF THE INVENTION

The present invention relates generally to projectiles. More particularly, this invention relates to projectiles with sealed propellant.

BACKGROUND

The kinetic energy (KE) of conventional projectiles, for example standard mortar rounds, may be varied by tailoring the amount of propellant that is associated with each projectile before firing. This may require different internal propellant loads produced during manufacture or the use of auxiliary propellant charges, where possible.

In mortar rounds, the projectiles and auxiliary propellant charges are generally separate from one another before firing. The auxiliary propellant is typically provided in a number of small parcels that may be supplied in different volumes or in the same volume for incremental use. Depending on the range that is required, the mortar operator manually attaches one or more parcels providing the appropriate amount of propellant to the mortar round before insertion into a tube or barrel for firing. This procedure also considerably slows the rate of fire that can be achieved by the weapon and is prone to human error when loading.

It will be appreciated that a more cost effective, convenient and reliable arrangement for varying the kinetic energy of projectiles is desirable, particularly where a high rate of fire is required. Particularly where the projectile firing weapon is of the type including a plurality of rounds stacked in a barrel for sequential firing and required to be remotely controlled. It would be of further advantage if the construction of individual rounds was substantially homogeneous.

SUMMARY OF THE DESCRIPTION

Projectiles with sealed propellant are described herein. In one embodiment of the invention, a projectile includes a chamber having a propellant charger, an exit from the chamber for release of propellant gases into a barrel when the propellant is ignited to fire the projectile, and a seal to block the exit which is opened by ignition of the propellant within the chamber but is resistant to ignition of other propellant in the barrel, where the seal is carried from the barrel by the projectile after the ignition.

Other features of the present invention will be apparent from the accompanying drawings and from the detailed description which follows.

BRIEF DESCRIPTION OF THE DRAWINGS

In order that this invention may be more readily understood and put into practical effect, reference will now be made to the accompanying drawings which illustrate embodiments of the invention, wherein.

DETAILED DESCRIPTION

Figure 1A:
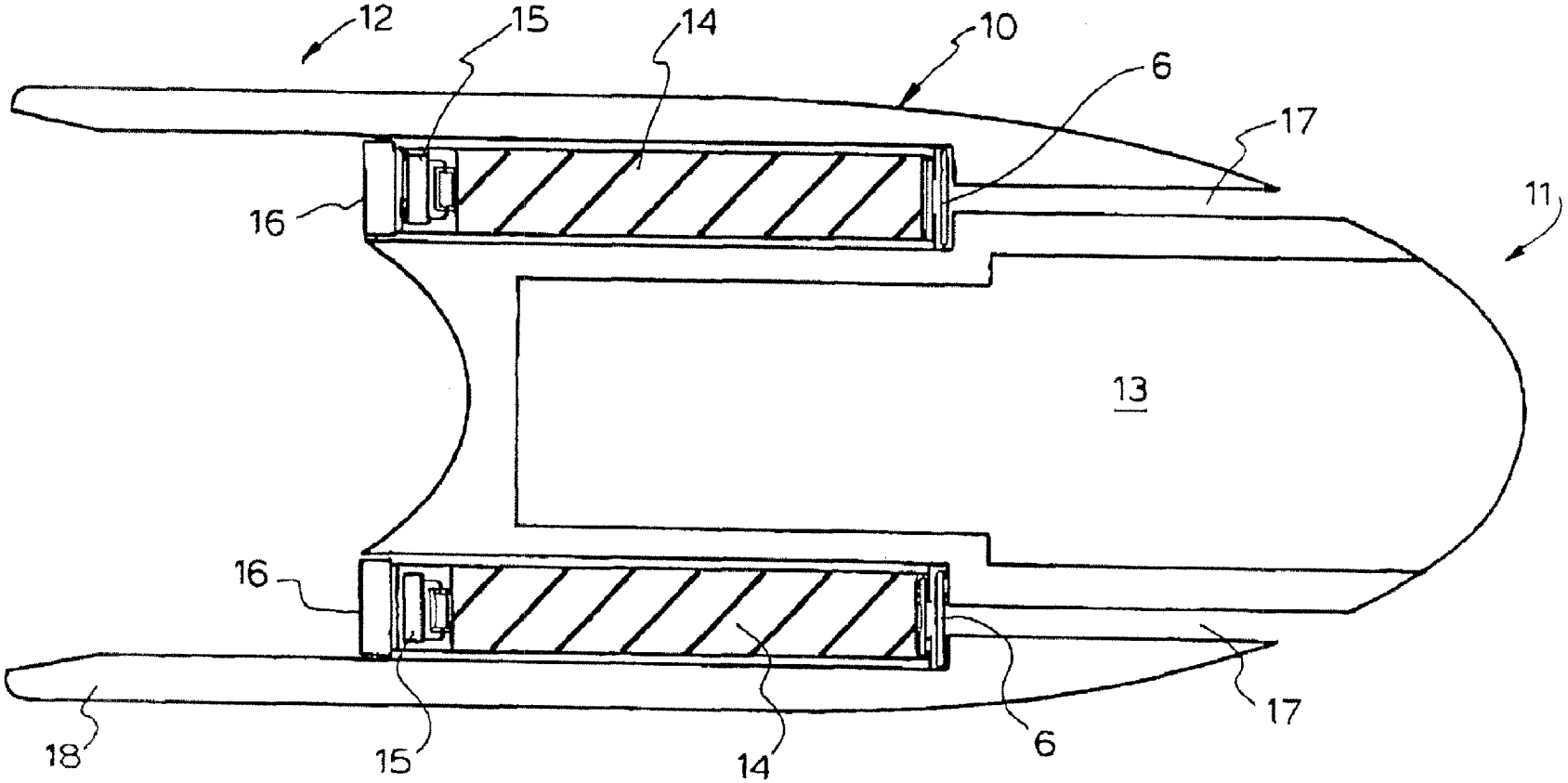
FIGS. 1A-1F show a first embodiment in which a projectile has forward ports for exit of propellant gases.

In the following description, numerous details are set forth to provide a more thorough explanation of embodiments of the present invention. It will be apparent, however, to one skilled in the art, that embodiments of the present invention may be practiced without these specific details. In other instances, well-known structures and devices are shown in block diagram form, rather than in detail, in order to avoid obscuring embodiments of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment.

Referring to the drawings it will be appreciated that the invention can be implemented in various ways for a variety of projectiles and purposes. The invention may be provided as a single projectile, as a weapon containing projectiles, or as a barrel assembly containing stacked projectiles for insertion in a weapon, for example.

The embodiments described herein relate to mortar rounds of up to about 60 mm caliber, it will be appreciated that the invention finds application in variety of projectile configurations. In particular, projectile configurations adapted for axial stacking in a barrel assembly and arranged for sequential firing, suitably by electronic means, as disclosed in earlier patent applications originating from either or both of these inventors.

FIG. 1A shows a projectile having a body 10 with nose and tail portions 11 and 12 adapted to be stacked in a barrel with other similar projectiles. The projectile typically includes a payload 13 which may be of various kinds such as explosive, flash-bang, smoke-generating or fire retardant for example. Propellant charges 14 are contained by cavities within the projectile and are selectively ignited by respective initiators 15, preferably inductive elements such as semiconductor bridges (SCBs), although a range of wired or wireless primer systems may be used. The charges are held in their cavities by plugs 16 which may be threaded or glued in place, for example. Ports 17 are provided in the nose portion for exit of the gases produced by combustion of the charges. In this example the ports open forwards and propel a leading adjacent projectile from the barrel. This projectile is in turn propelled by charges in a trailing adjacent projectile or by charges in the base of the barrel. The nose portion is preferably shaped to fit the tail portion of the leading projectile and similarly the tail portion is shaped to fit the nose portion of the trailing projectile. This provides a degree of sealing between the projectiles and may be achieved in various ways.

Figure 1B:
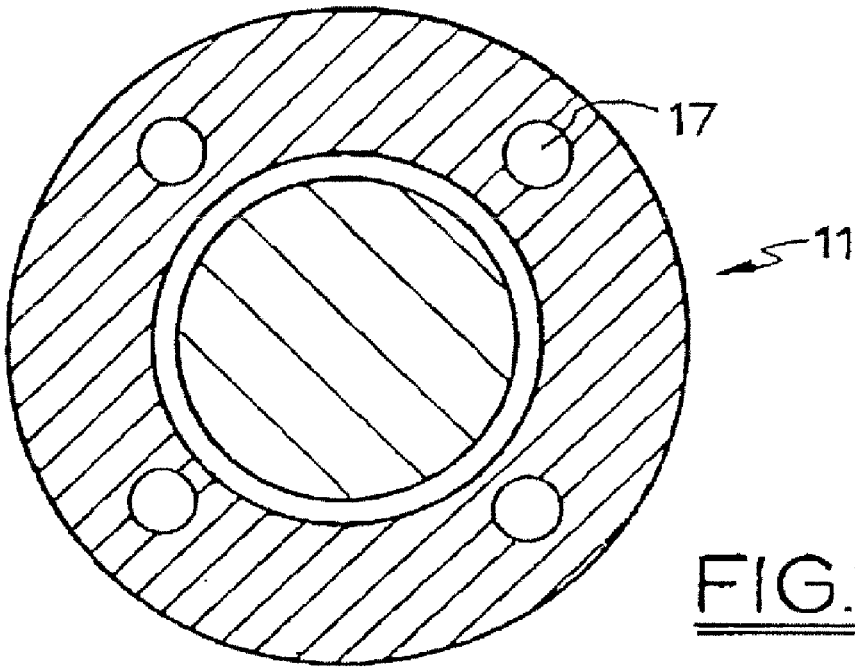
Figure 1C:
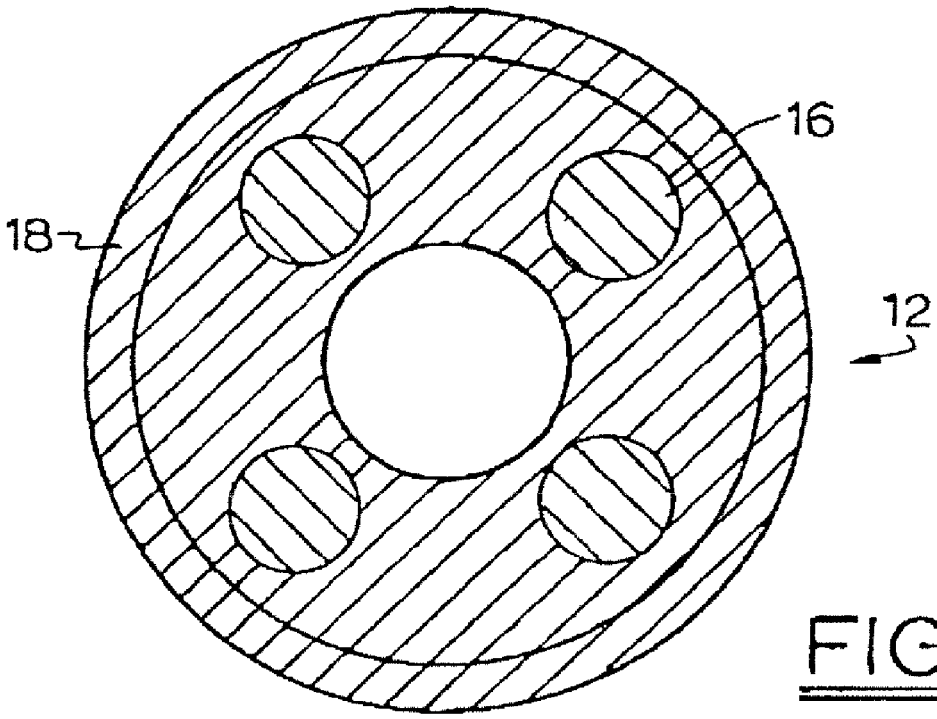

FIGS. 1B and 1C are end views of the projectile in FIG. 1A showing the nose and tail portions. There are four propellant charges 14 located symmetrically around the longitudinal axis of the projectile, retained by four plugs 16 and correspondingly provided with four ports 17 for exit of combustion gases. The number and arrangement of the charges may be varied to suit the purpose of the particular projectile. It should be borne in mind however, that the flight characteristics of the projectile may change when the charges are selected and ignited, unless all of the charges are ignited before the projectile is fired from the barrel. The centre of mass of the projectile may shift for example.

Figure 1D:
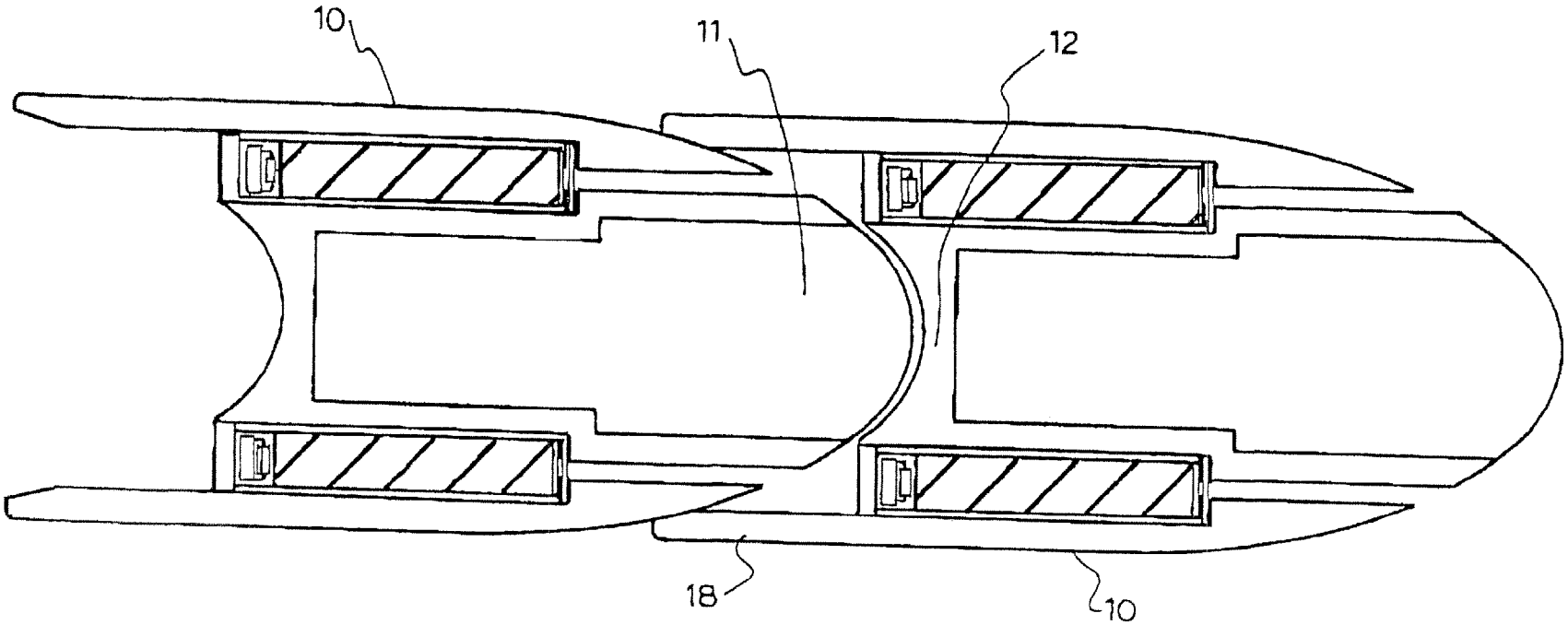

FIG. 1D shows how two projectiles of this kind may be stacked in a barrel. The nose portion 11 of the trailing projectile fits the tail portion 12 of the leading projectile, and preferably expands the tail portion 12 into a sealing contact with the inside of the barrel. In this example, a convex curved surface of the nose portion matches a concave surface in the tail portion, and the tail portion also includes a rim 18 that contacts the body of the trailing projectile. One or more charges in the trailing projectile are selected and ignited to propel the leading projectile from the barrel with a required kinetic energy. Once the leading projectile has departed any charges remaining in the trailing projectile are ignited to produce a predetermined weight and centre of mass in the trailing projectile, which is now the leading projectile. Each projectile therefore has reasonably standard and predictable characteristics for flight.

Figure 1E:
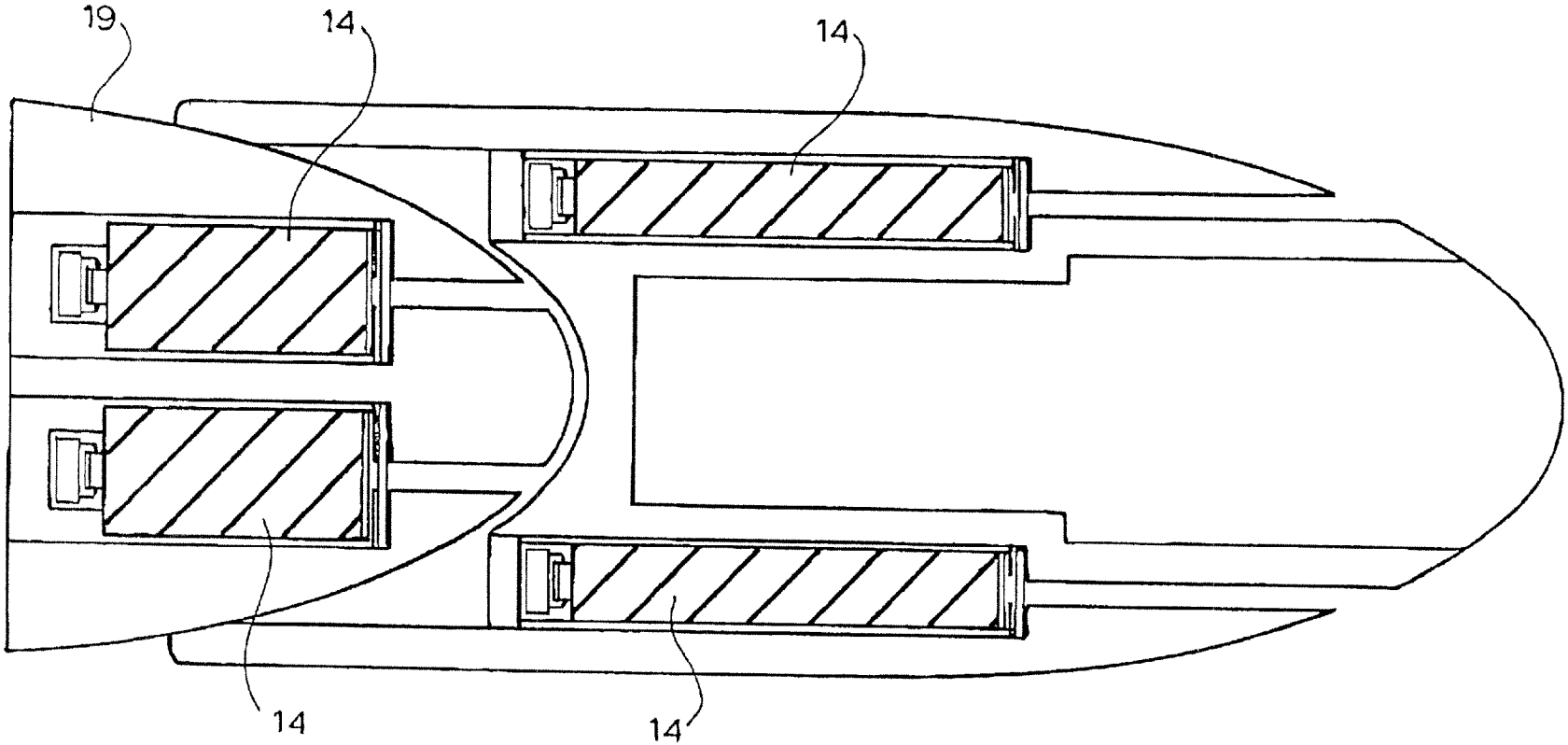
Figure 1F:
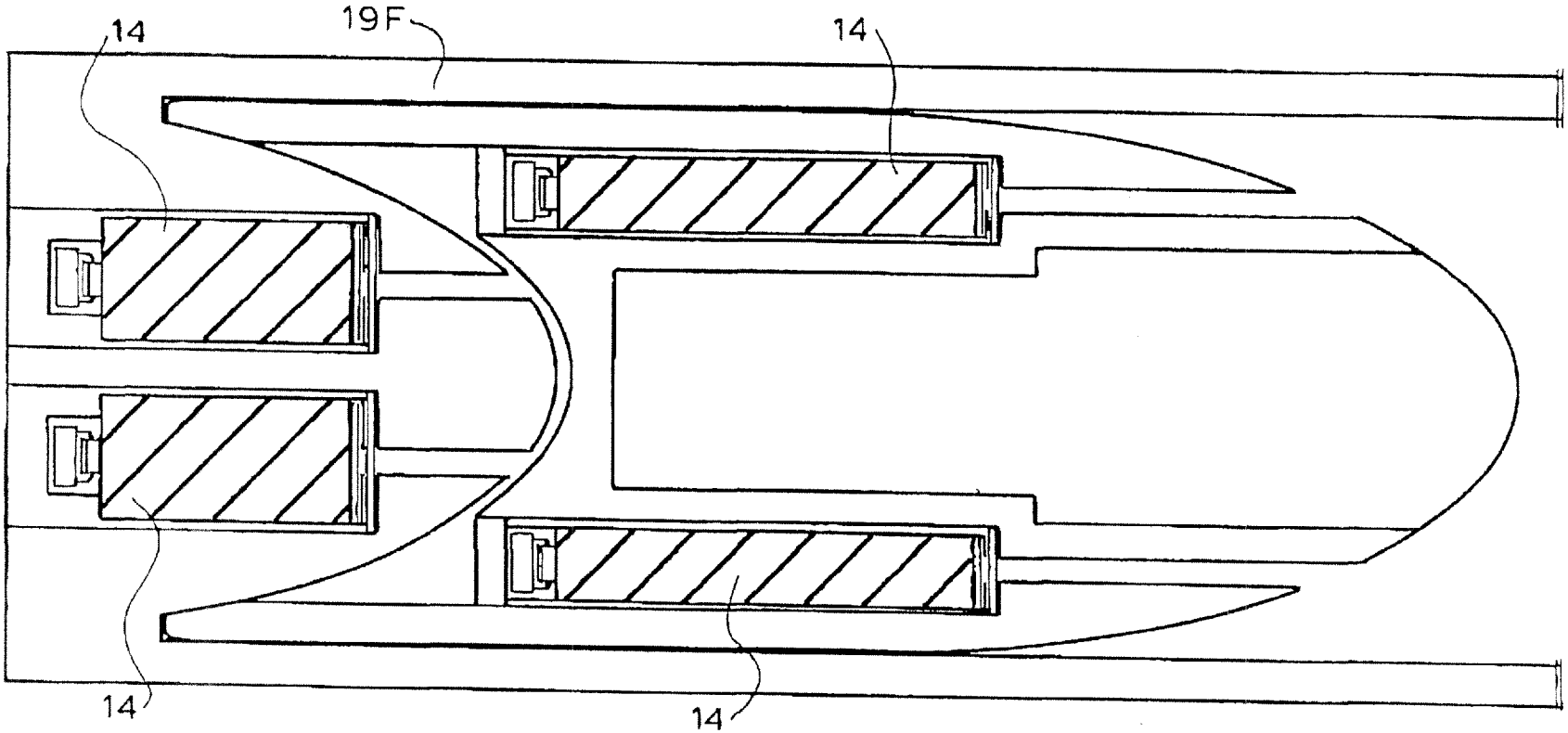

FIGS. 1E and 1F show how the last projectile in a stack of projectiles of this kind may be fired. Propellant charges 14 may be provided in the base of the barrel as either a separate removable element 19E, or as a fixed element 19F of the barrel itself. The charges 14 in each of these figures are contained and ignited in a manner similar to that of the charges in the projectiles. The separate base element 19E is preferably loaded down the barrel before the projectiles while the fixed base element while charges in the fixed element 19F may be loaded as individual items from the rear of the barrel. These charges may be selected and fired to provide a predetermined kinetic energy to the last projectile.

Figure 2A:
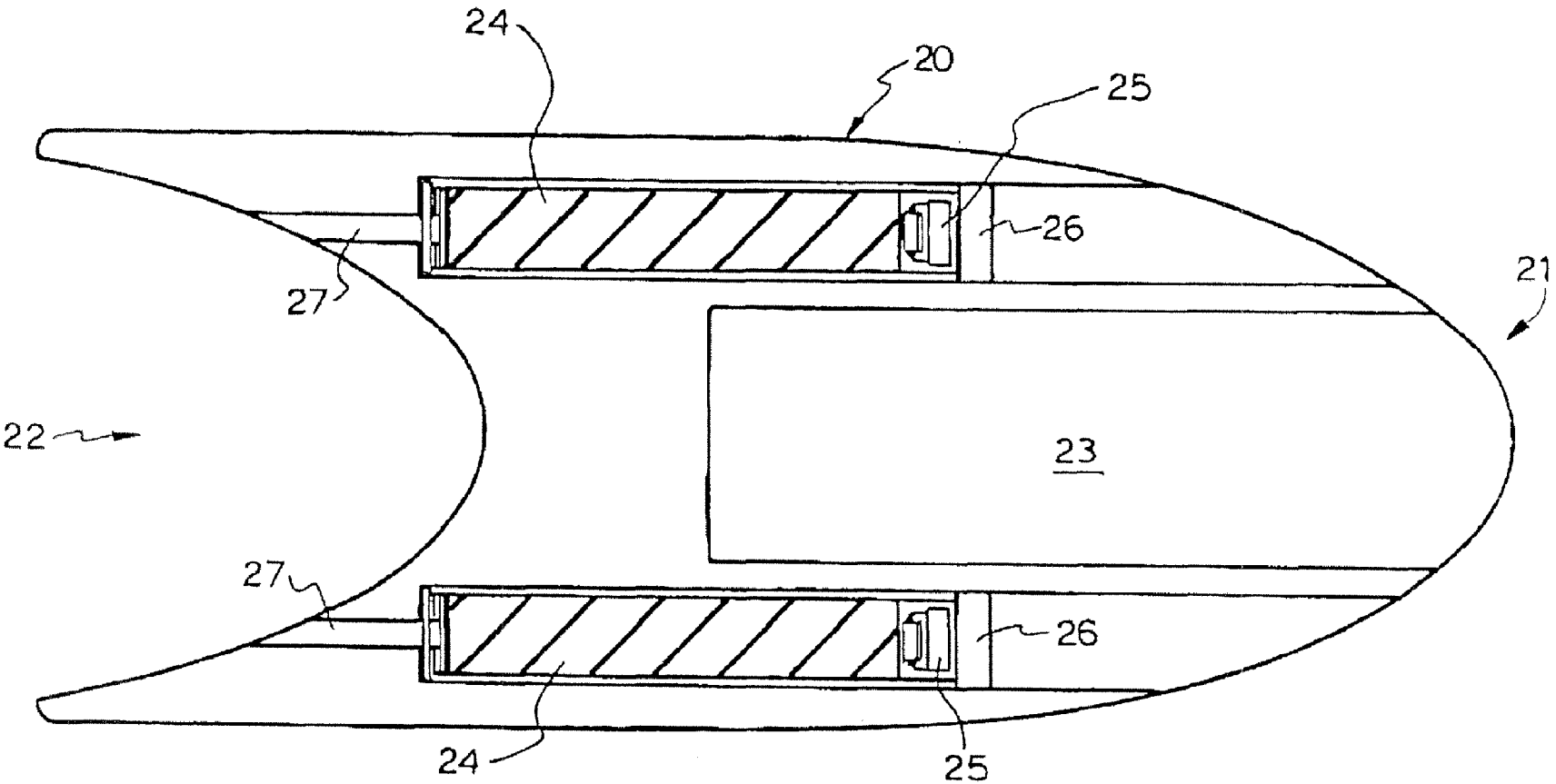
FIGS. 2A-2D show a second embodiment in which a projectile has rearward ports for exit of propellant gases.

FIG. 2A shows an alternative projectile having a body 20 with nose and tail portions 21 and 22, adapted to be stacked in a barrel with other similar projectiles if required. The projectile includes a payload 23 in this example. Propellant charges 24 are contained by cavities within the projectile and are selectively ignited by respective initiators 25, preferably inductive elements such as semiconductor bridges (SCBs), although a range of wired or wireless primer systems may be used. The charges are held in their cavities by plugs 26 which may be threaded or glued in place, for example. Ports 27 are provided in the tail portion for exit of the gases produced by combustion of the charges. In this example the ports open rearwards and propel the respective projectile from the barrel. The nose portion is preferably shaped to fit the tail portion of the leading projectile and similarly the tail portion is shaped to fit the nose portion of the trailing projectile. This provides a degree of sealing between the projectiles and may be achieved in various ways.

Figure 2B:
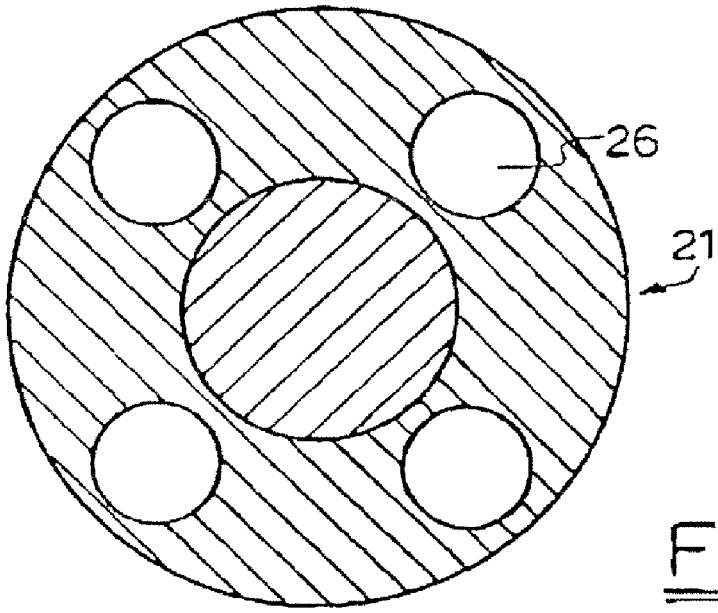
Figure 2C:
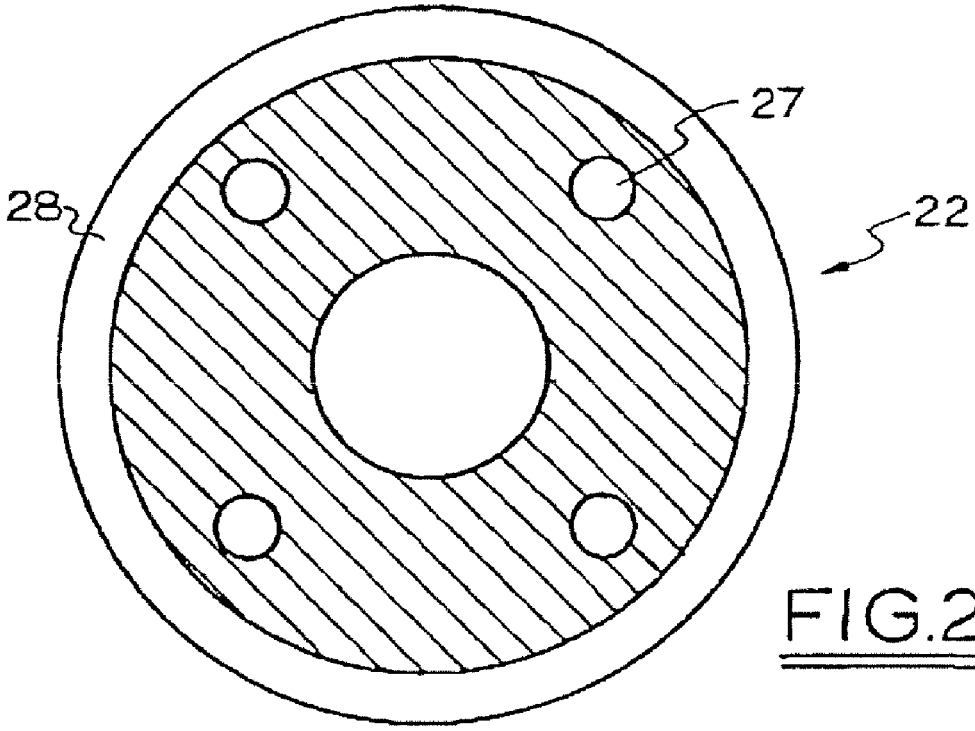

FIGS. 2B and 2C are end views of the projectile in FIG. 2A showing the nose and tail portions. There are four propellant charges 24 located symmetrically around the longitudinal axis of the projectile, retained by four plugs 26 and correspondingly provided with four ports 27 for exit of combustion gases. The number and arrangement of the charges may be varied to suit the purpose of the particular projectile, bearing in mind that the flight characteristics of the projectile may change when the charges are selected and ignited. The weight and centre of mass of the projectile may change for example. On the other hand, the rearward exit ports are less likely to create drag.

Figure 2D:
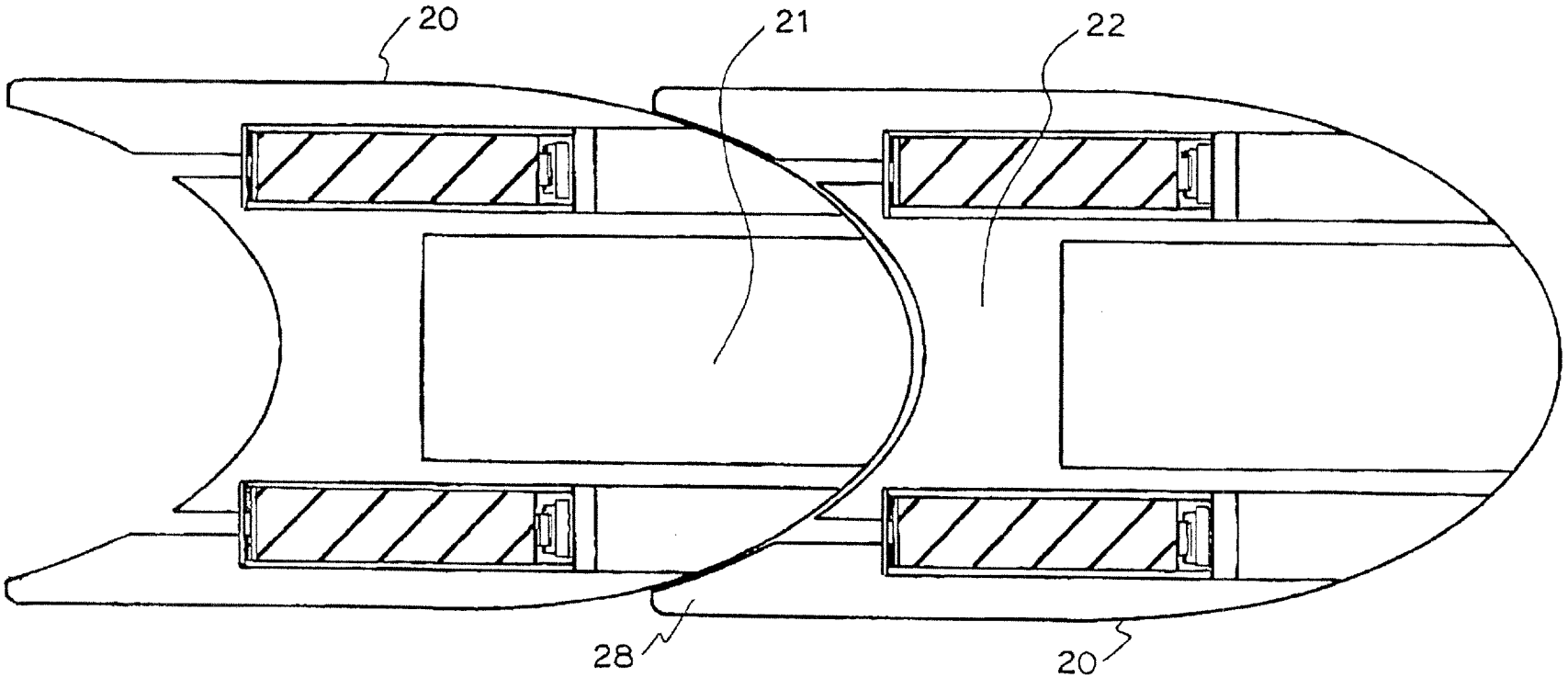

FIG. 2D shows how two projectiles of this kind may be stacked in a barrel. The nose portion 21 of the trailing projectile fits the tail portion 22 of the leading projectile, and preferably expands the tail portion 22 into a sealing contact with the inside of the barrel. In this example, a convex curved surface of the nose portion matches a concave surface in the tail portion, and the tail portion also includes a rim 28 that contacts the body of the trailing projectile. It will be appreciated that a wide range of shapes and dimensions may be used in any of the projectiles described herein. One or more charges in each projectile are selected and ignited to propel the respective projectile from the barrel with a required kinetic energy. The projectiles generally have less predictable flight characteristics than those of FIG. 1A.

Figure 3A:
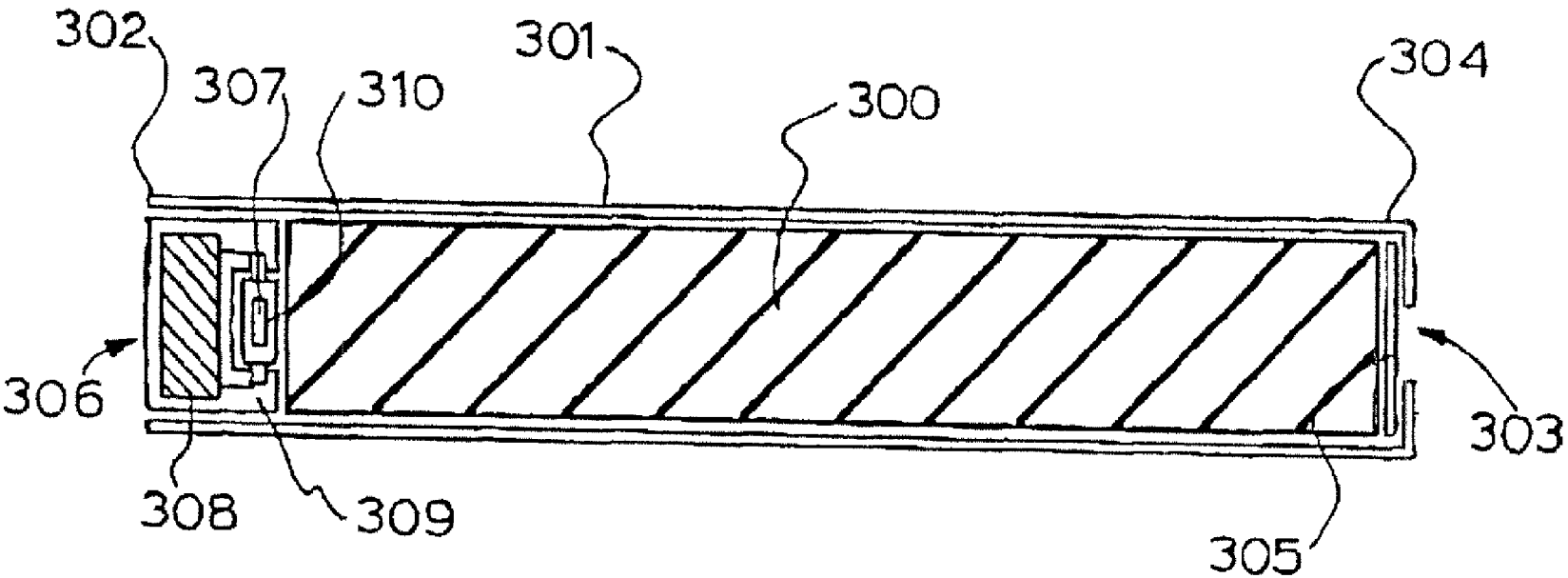
FIGS. 3A, 3B show an inductive firing system for the projectiles.

FIG. 3A shows a typical propellant charge 14 or 24 from FIGS. 1 and 2 in more detail. The charge material 300 is contained by a metal housing 301, open fully at one end 302 and with a smaller aperture 303 at the other end 304. A disc 305 of composite material blocks the aperture 303 but is ruptured on ignition of the charge material so that combustion gases can pass through the aperture into a respective exit port. An initiator 306 is threaded or press-fitted into end 302, based on an SCB igniter in this example. The initiator includes the SCB 307 connected across a coil 308, both mounted in a fitting 309 of plastic for example. A small amount of pyrotechnic material 310 surrounds the SCB to act as a booster in combustion of the charge material. Many alternative structures could be used for the propellant charges and for the initiator, which could also be introduced directly to cavities in the projectile without need of the housing 301 for example.

Semiconductor bridges are known devices having the appearance of a microchip with two terminal wires, such as shown in U.S. Pat. No. 4,708,060 and subsequent US patents. If an electric potential is placed across these two wires, the semiconductor bridge releases a small amount of energy, most in the form of heat. The energy released by the SCB may in some cases be insufficient to ignite the propellant charges directly and the initiators may further require a set-up chemical compound (i.e. a compound which is capable of being initiated by an SCB and will, in turn, ignite the charge). SCBs can be designed and arranged such that a current induced between the two terminals can cause energy release. It is considered that the various means of inducing a current in a coil of wire using a magnetic field (induction) are well enough understood by those proficient in the art that such details need not be discussed here, save one example. It is therefore to be taken that all such means of providing a suitable firing current, whether by inducing said current or otherwise, are within the ambit of this invention.

Figure 3B:
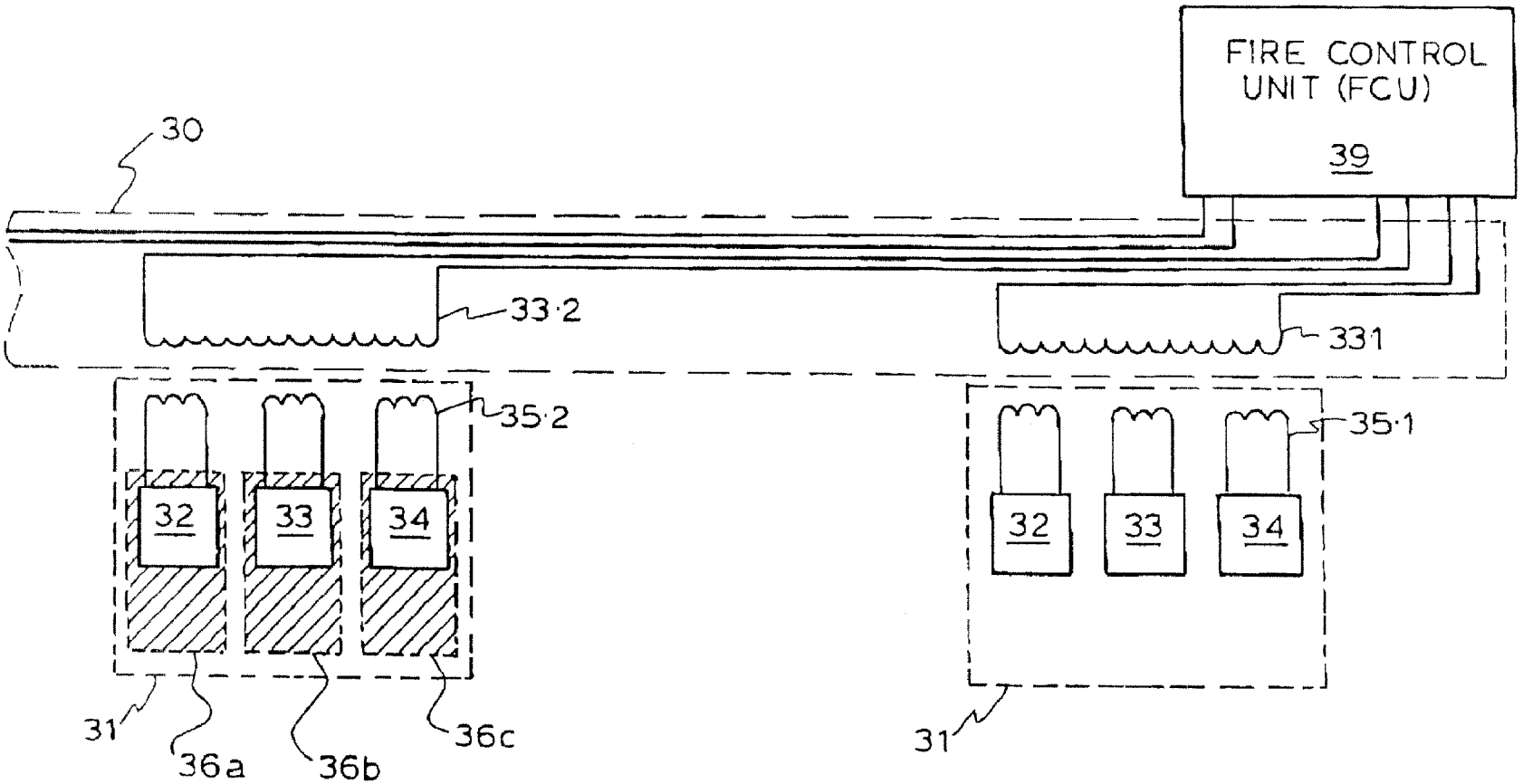

FIG. 3B schematically shows an inductive firing system that may be used to launch the projectiles shown in FIGS. 1 and 2. A magnetic field suitable to activate an SCB can be induced using a signal transmitting coil 33 wrapped around the barrel 30, suitably in the vicinity of projectiles 31 therein, i.e. one transmitting or primary coil 33.1, 33.2, etc. for each projectile 31.1, 31.2, etc. The current in the primary coils 33 can be selectively turned on or off by a fire control unit (FCU) 39 and thus the resulting current in receiving or secondary coils 35.1, 35.2 can be manipulated in the same fashion. The primary coils may be connected separately to the FCU or in series. The FCU may be operated in various ways to select the kinetic energy and therefore the charges to be ignited for the next projectile to be fired. A manual user could operate a rotatable switch that simply indicates 1, 2, 3 . . . or all of the charges are to be ignited. The user or an automated firing system determines the kinetic energy required for a particular projectile according to the environment in which the user or the automated system is located.

In order to fire the charges in a designated projectile (for example projectile 31.2), the FCU 39 applies firing signal current to the primary coil 33.2 wrapped around the barrel 30 for that projectile 35.2. The resultant magnetic field induces a current in the secondary coil 35.2, which is applied to the two terminals of the initiators 32, 33, 34. Ignition of one or more propellant charges 36*a*, 36*b*, 36*c* occurs in response to those initiators arranged to ignite upon receipt of the firing signal.

SCBs can also be designed such that they will not initiate due to a simple current but only when a particular "type" of current occurs. Indeed, SCB technology now offers the ability to manufacture SCBs that require various and distinct levels of energy of ignition signal to activate the energetic material. Encoders and decoders could also be used in conjunction with SCB technology, if required. Where encoders/decoders and other logic circuits are employed, a signal modulation scheme may comprise any pulse wave modulation (PWM), pulse code modulation (PCM) or pulse amplitude modulation (PAM) scheme, or in any other suitable encoding scheme. This allows the separate, smaller propellant charges 36 to be discretely ignited via the common induction coil pairs 33, 35.

We now turn to consider the use of variations in current to embed an ignition signal as an example. In order to fire propellant charge 36*a* for the designated (or any particular) projectile 35.2 the FCU 39 applies current (with the appropriate modulated variations embedded within it) to the primary coil 33.2 associated with that projectile. The resultant current in secondary coil 35.2 (induced by the magnetic field) thus varies in intensity in proportion to the variations in current the FCU has applied. The induced current that is delivered to the SCBs thus also varies in proportion with the variations in intensity of the magnetic field. Thus the appropriate SCB 32 in propellant load 36*a* of the projectile 35.2 can be delivered the appropriate coded signal and therefore be initiated without the initiation of propellant charges 36*b* or 36*c*, through the use of a single induction coil 33 per projectile.

It will be appreciated that, upon initiation of a selected propellant charge or charges 36, the rapid combustion thereof operates to discharge the associated projectile from the barrel 30. Where only one propellant charge is initiated, eg. centre charge 36*b* by SCB 33, the kinetic energy imparted to the projectile will be considerably lower than imparted when all three propellant charges 36*a*, 36*b*, 36*c* are initiated.

FIGS. 4 to 8 of the drawings depict a projectile 45 of another embodiment of the invention having a projectile body 46 with a cavity 49 wherein a plurality of propellant charges 50 are disposed longitudinally in the projectile. In contrast, the propellant charges of the embodiments discussed above were disposed laterally within the projectile. For reasons of clarity, the initiators and secondary or receiving coils have been omitted from these drawings.

Figure 4:
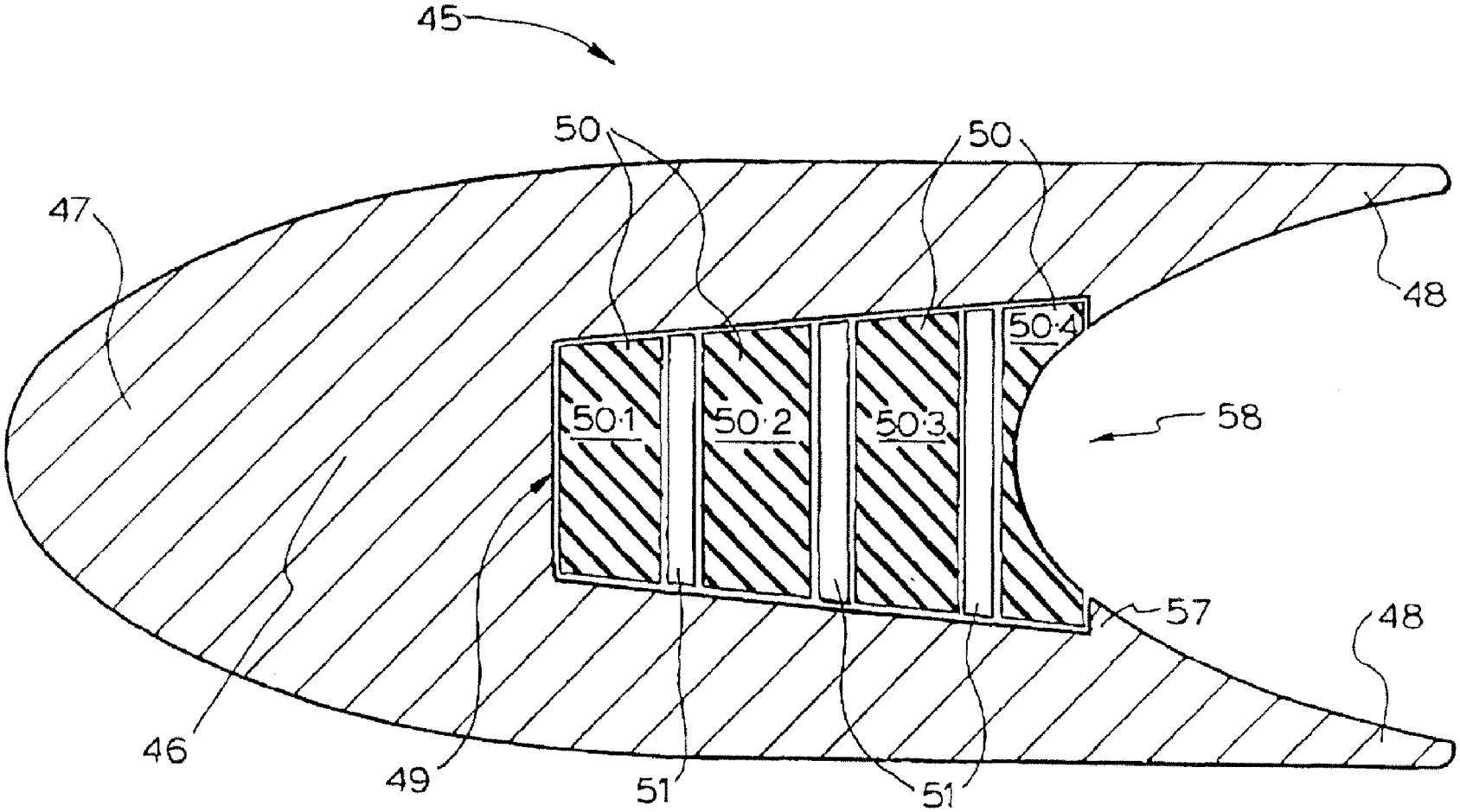
FIG. 4 is a sectional side elevational view of a projectile of another embodiment of the invention, prior to firing.

The projectile 45 is depicted in FIG. 4 prior to ignition of any of the propellant charges 50, which charges are separated from one another with the cavity 49 by wall members. The propellant charges 50 are composed of a mouldable material in the present embodiment, whereby the rearmost charge 50.4 is exposed through the aperture 58 communicating with the exterior of the projectile adjacent a tail portion of the body 46. Suitably the wall members are in the form of sealing discs 51 having edge surfaces with profiles arranged to wedge into a shallow inwardly tapered wall of the cavity 47. Accordingly, the shaped propellant charges and alternating sealing discs may be located into the cavity 49 via the aperture 58 from the tail 48 of the projectile 45.

Since the propellant cavity becomes smaller in diameter toward the head portion 47 of the projectile, if the first loaded sealing disc 51 is forced toward the head 47 of the projectile, wedging will occur between the band edge and the tapered interior wall of the cavity 47, and the disc will retain the forwardmost charge 50.1 in place. Accordingly, when a similarly directed force is applied during firing, e.g. the force resulting from combustion of the second propellant charge 50.2 being initiated, the sealing disc 51 will further be wedged into place with said interior wall 56. This "wedge-sealing" action aims to reduce the likelihood of ignition of propellant charge 50.2 causing any sympathetic or "blow-by" ignition of propellant charge 50.1.

Ignition of propellant volume 50.1 however will push the adjacent sealing band in the other direction, both unlocking it and forcing it toward the tail 48 of the projectile 45. The sealing disc 51 will not move far before the edge of the sealing disc loses contact with the cooperating interior wall 56 of the cavity, thereby allowing burning propellant 50.1 to reach rearward propellant charge 50.2. The next rearward propellant charge 50.2 is thus ignited and the process continues rapidly until propellant volume 50.4 is ignited. In summary, the ignition of a particular propellant charge 50 will not ignite a propellant charge that is closer to the nose of the projectile, as explained above.

Figure 5:
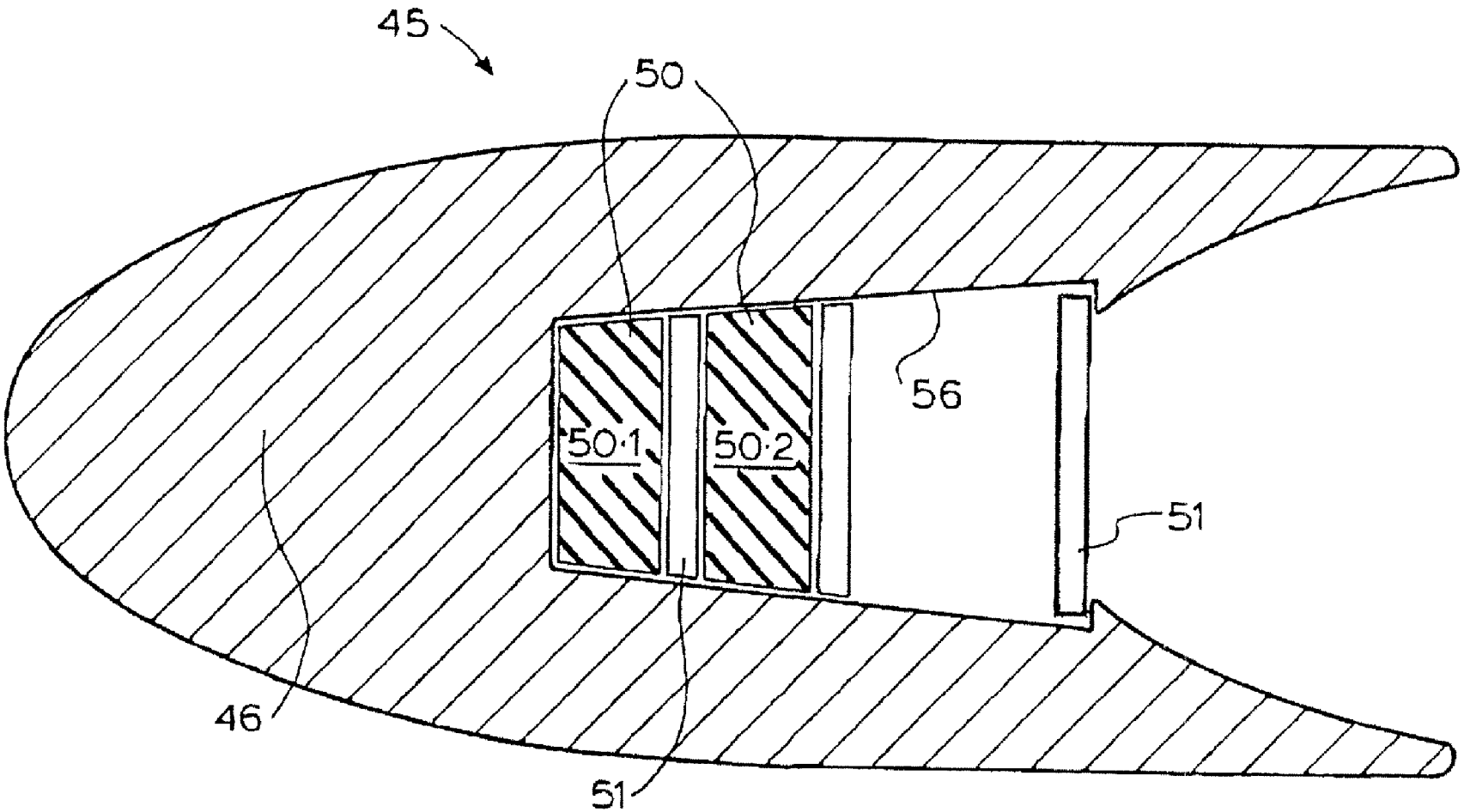
FIG. 5 is a sectional side elevational view of the projectile of the embodiment, after firing the third and fourth propellant charges.
Figure 6:
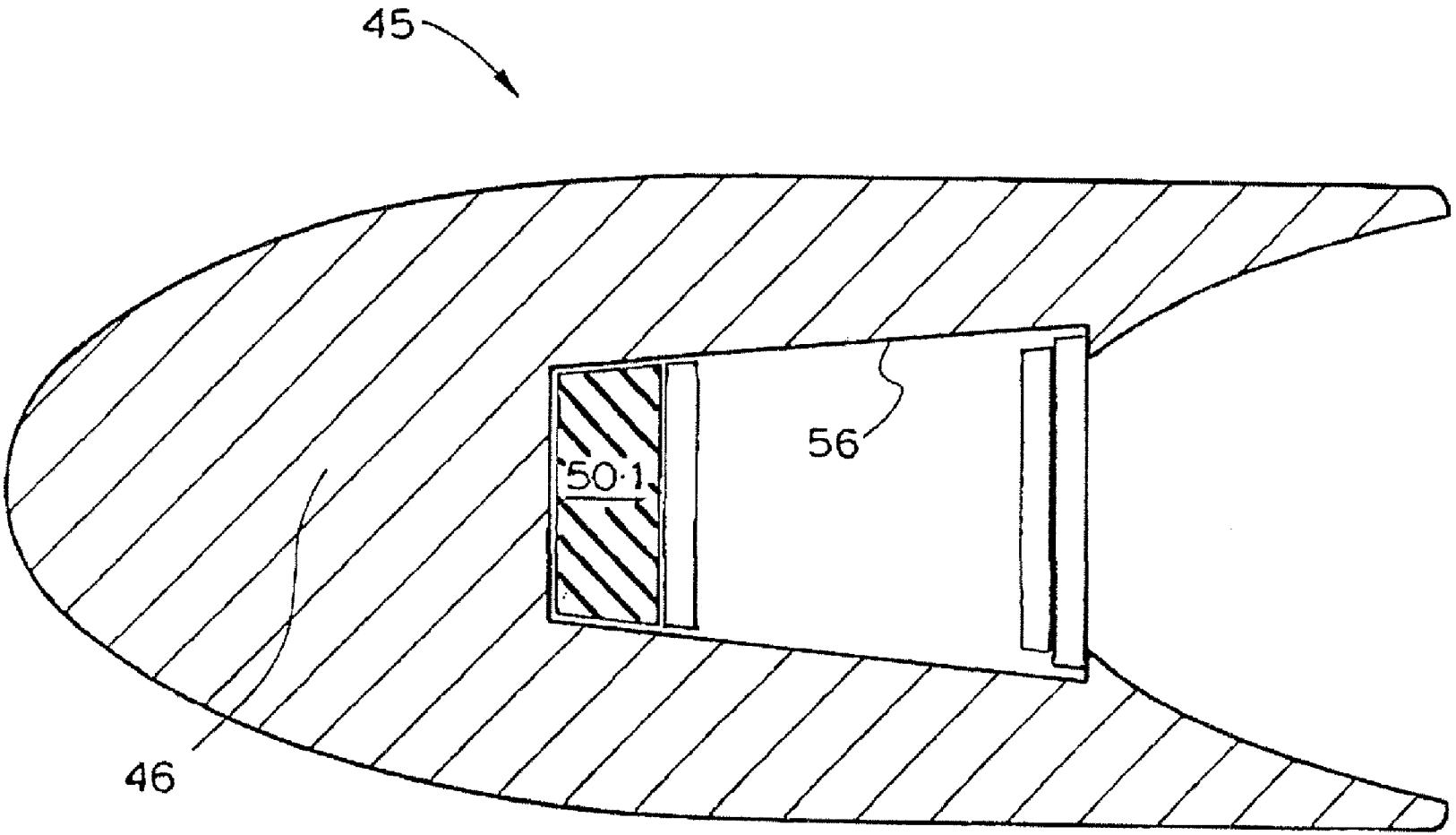
FIG. 6 is a sectional side elevational view of the projectile of the embodiment, after firing the second, third and fourth propellant charges.
Figure 7:
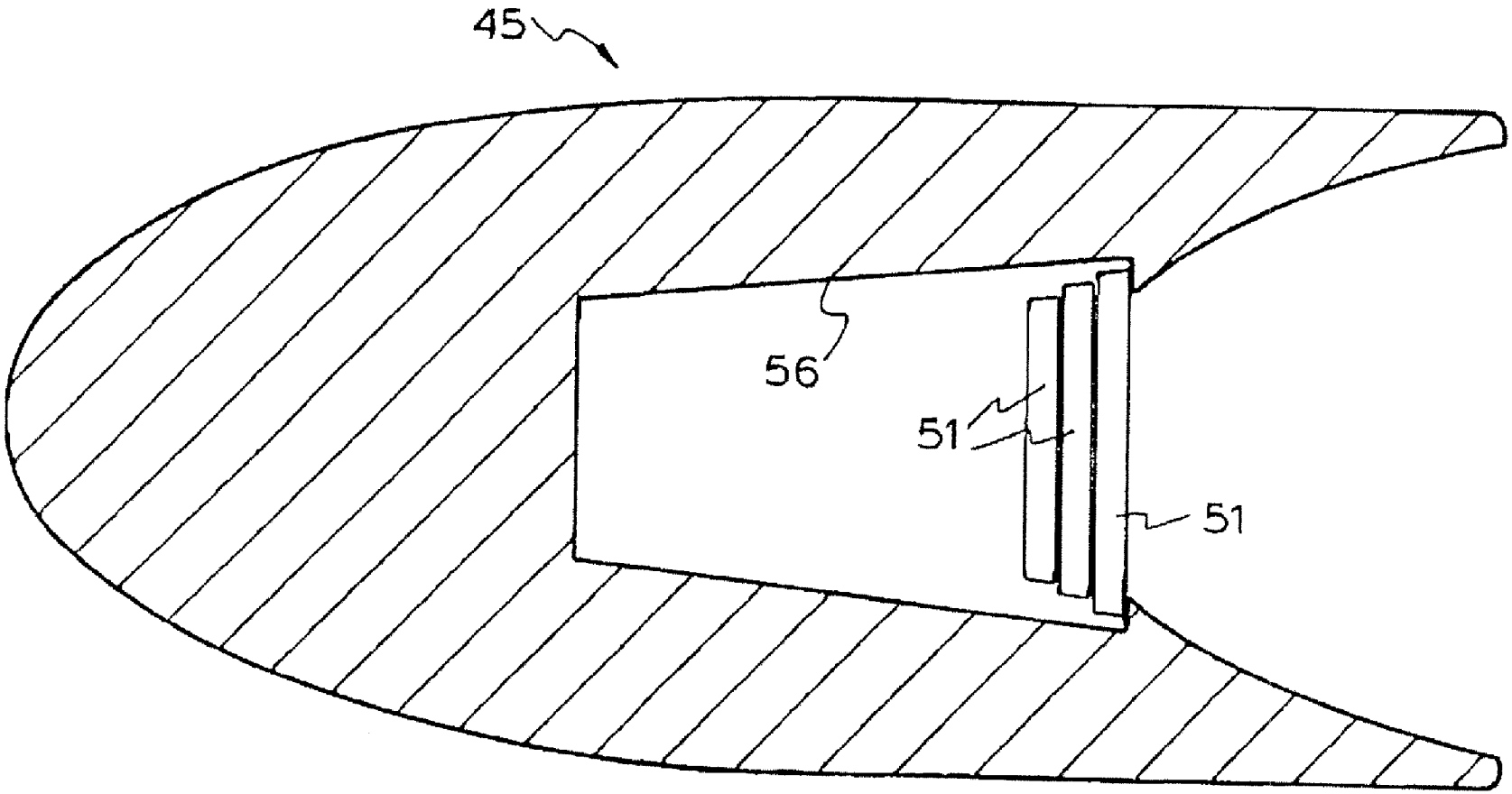
FIG. 7 is a sectional side elevational view of the projectile of the embodiment, after firing all propellant charges.
Figure 8:
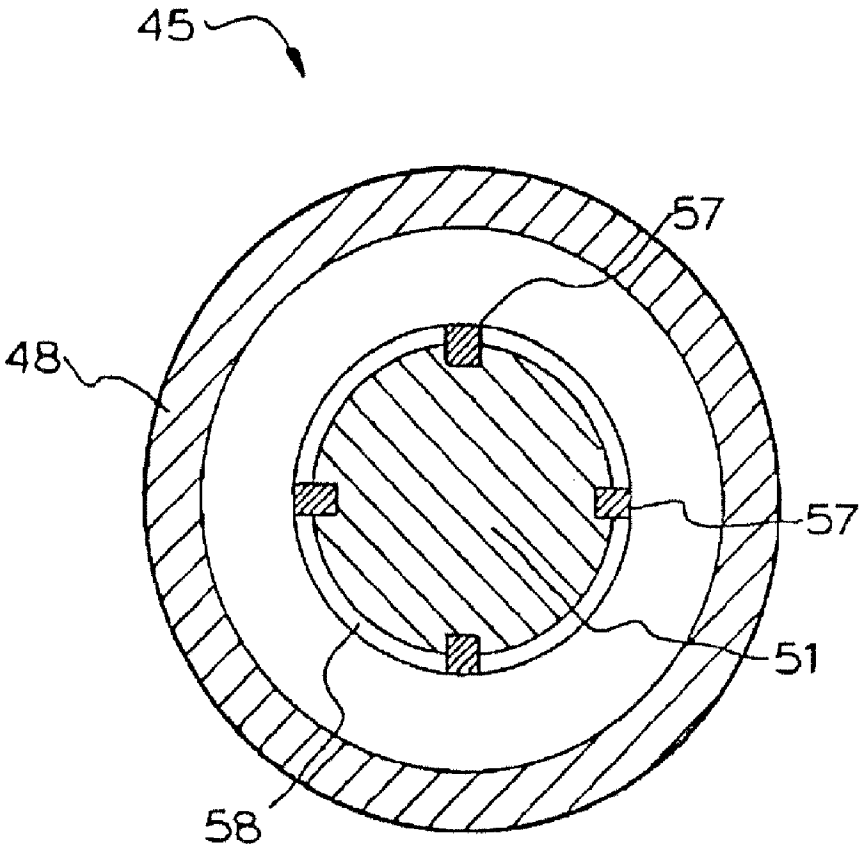
FIG. 8 is a sectional end elevational view of the projectile of the embodiment.

FIGS. 5, 6 and 7 show the consequences of igniting a selected propellant charge in the projectile 45. In FIG. 5 the third propellant charge 50.3 has been ignited resulting in the combustion of charges 50.3 and 50.4. In FIG. 6, the second propellant charge 50.2 has been ignited resulting in the combustion of charges 50.2, 50.3 and 50.4. In FIG. 7, the first propellant charge 50.1 has been ignited, resulting in the combustion of all propellant charges.

The aperture includes means for resisting the expulsion of the sealing discs from the cavity, which take the form of a plurality of inwardly radially extending fingers or catch points 57 (as depicted in FIGS. 4 to 8) to stop or at least resist the sealing discs 51 from being expelled or otherwise leaving the projectile cavity 49 entirely. There are several small catch points 57 disposed around the periphery of the aperture 58, as will be apparent from the view of FIG. 8. A preferred alternative involves the catch points extending fully across the aperture in the form of a crossbar to ensure that the discs are contained within the projectile. In another form, the wall members or sealing discs may be constructed of a combustible material which has an outer face treated in order to resist combustion, ie. consumption may only be initiated by propellant burning forward of the wall member.

Figure 9:
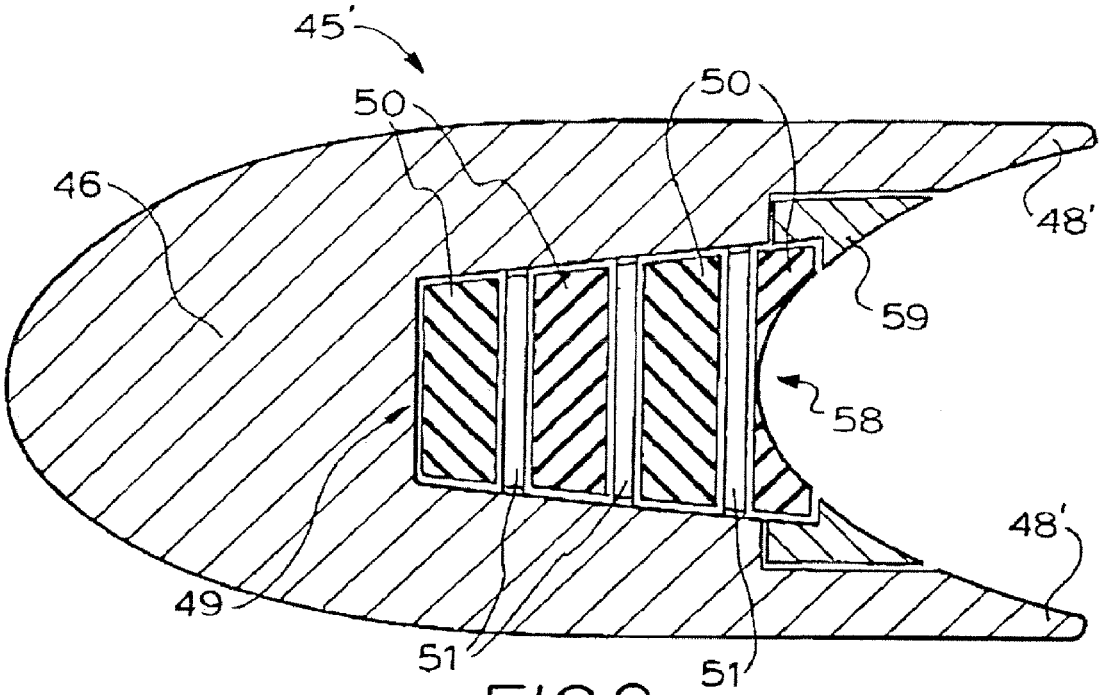
FIG. 9 is a sectional side elevational view of a variation to the projectile of the embodiment.

Since it may or may not be viable for the catch points to be conveniently manufactured as part of the projectile, the catch points 57 may be formed as a separate component 59 that is removably retained in the tail portion 48', such as by cooperating screw threads (not shown), once the cavity 49 has been loaded with propellant charges 50 and respective sealing discs. This component modification of the fourth embodiment is shown in FIG. 9.

In a further modification, the entire cavity portion 49 including the rearward aperture 58 may be formed as a separate component and similarly removably retained in the projectile body 46. The separate component containing the cavity could alternatively be formed with the lateral arrangement of propellant charges and respective expansion bleed ports as described above.

Figure 10:
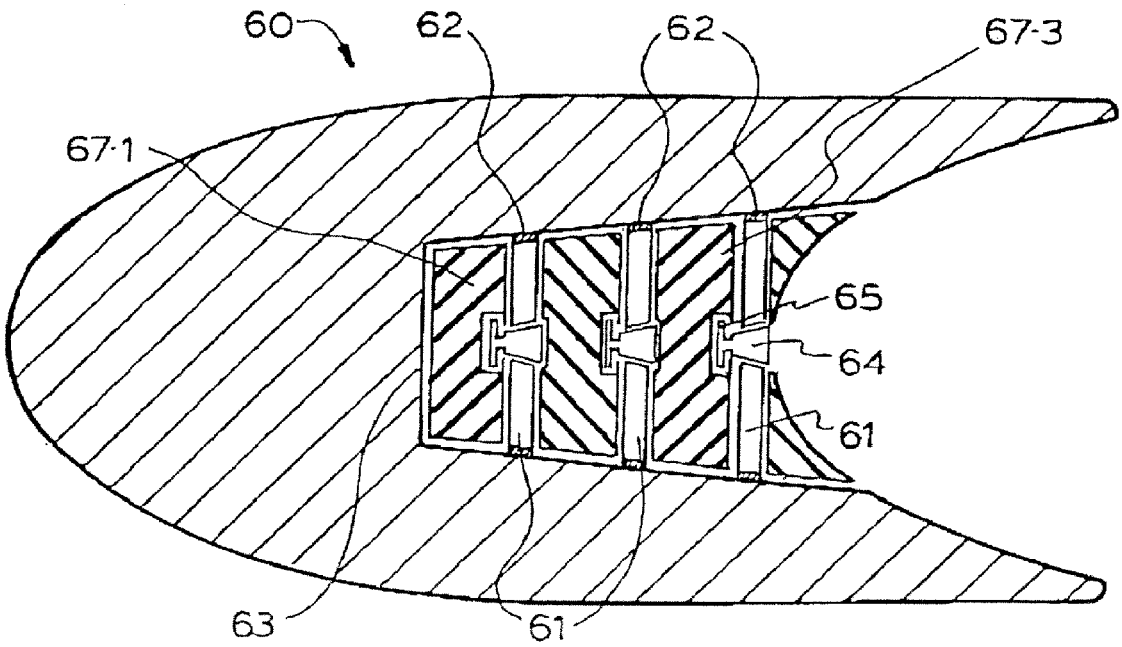
FIG. 10 is a sectional side elevational view of a projectile of another embodiment of the present invention, prior to firing.
Figure 12:
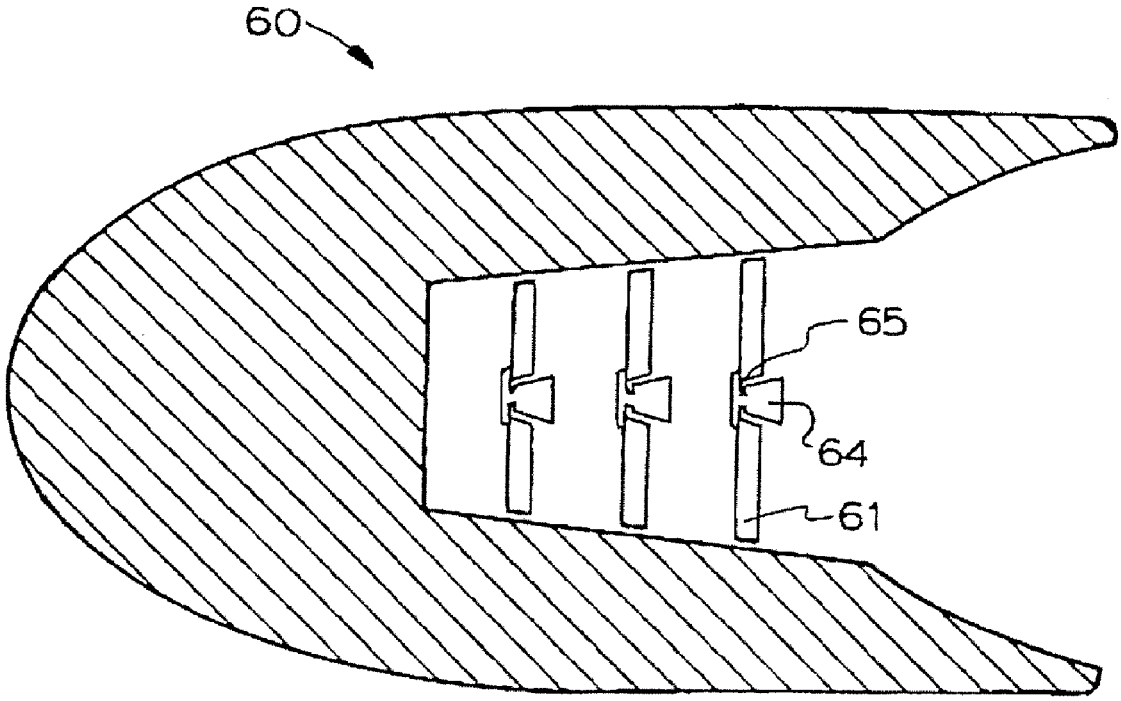
FIG. 12 is a sectional side elevational view of a projectile of a embodiment of the present invention, subsequent to firing all propellant charges.

In a fifth embodiment of the present invention depicted in FIGS. 10 and 12 (again omitting the initiators and secondary or receiving coils), a projectile 60 includes wall members 61 that are themselves screw threaded into place via cooperating threads 62 provided on the wall member edges and the interior wall of the propellant cavity 63, respectively. Furthermore, as shown in FIG. 10, the wall members 61 each include sealing plugs 64 that are wedged into place in the wall members in a similar fashion as the sealing discs discussed above.

Figure 11:
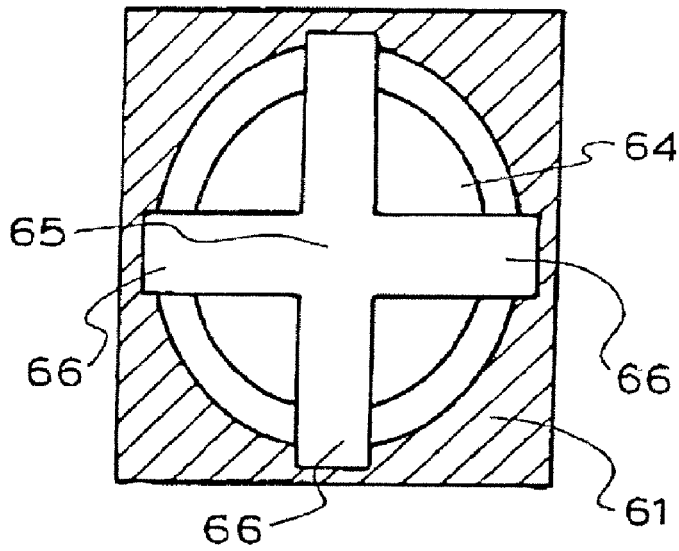
FIG. 11 is a sectional end elevational view of the projectile of the embodiment.

The sealing plugs 64 are outfitted with a small T-shaped retaining member 65 that stops or at least resists the plugs from leaving the projectile cavity 63 entirely. It is presently expected that the sealing plugs 64 would need to be manufactured as two pieces (ie. plug and retaining member) and assembled in situ. In a similar fashion to the fourth embodiment discussed above, the T-shaped portion is made up of several small catch points, rather than using the entire ring. However, in this embodiment, the catch points are a plurality of radially outwardly extending fingers 66 of somewhat cruciform configuration. Also as above, this is so that when a T-shaped member 65 hits its respective wall member 61, it does not close off the propellant charge 67 to the exterior of the projectile 60, as shown in the enlarged cross-sectional view of the FIG. 11.

It is presently considered that the T-shaped retaining member 65 may only be necessary for the screwed-in wall member 61 closest to the rear of the projectile. FIG. 12 shows the end result of igniting the forwardmost propellant charge 67.1 in this scenario. The individual propellant charges 67 may be ignited using only one induction coil per projectile (as discussed above in relation to FIGS. 1A and 1B) with different coded SCBs for each propellant charge 67.1, 67.2, 67.3, etc. Accordingly four (4) different kinds of code responsive SCBs would be required in the presently illustrated example of the fifth embodiment.

The above embodiments of the invention all entail the use of separate (and generally volumetrically smaller) propellant charges. Typically the operator can elect or an automated fire control system can determine, to burn ¼ of the available propellant, ½, ¾ or all of the propellant available to a particular projectile. However, it is to be understood that propellant volumes need not be divided in this manner, and in fact can be divided in any way desired.

Figure 15:
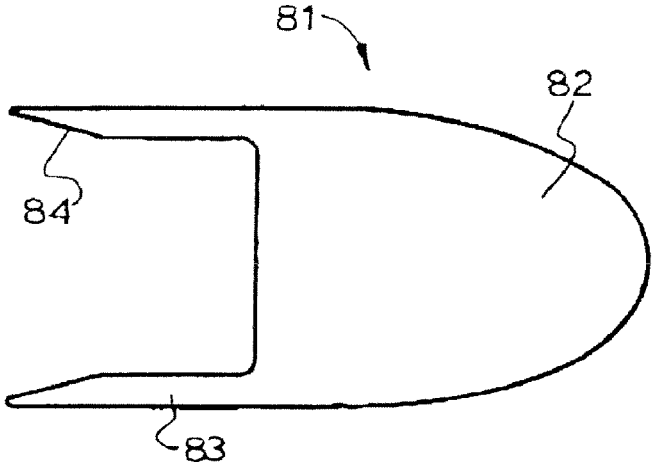
FIGS. 15, 16 and 17 depict a projectile assembly of a embodiment of the present invention.
Figure 16:
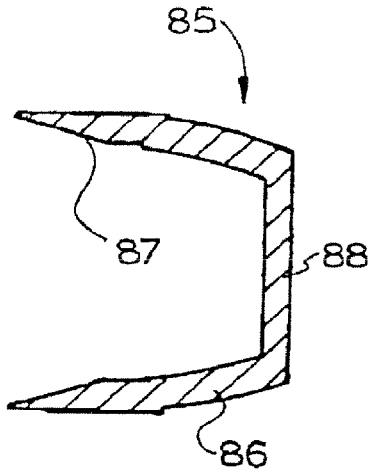

In FIGS. 15 and 16 of the drawings there are shown components of a projectile assembly of the type described in the present applicant's International Patent Application No. PCT/AU02/00932. The earlier invention was concerned with the staged or sequential ignition a plurality of propellant charges associated with each projectile in order to reduce in-barrel pressures whilst maintaining projectile muzzle velocity during firing.

The applicant has now realized that the present invention may also find a further application as discussed in relation to this sixth embodiment. Here each projectile assembly 80 includes a main projectile body 81 with a head portion 82 and a rearwardly extending tail portion 83 having a tapered skirt 84, as depicted in FIG. 15. The projectile assembly 80 also includes a plurality of propellant cup members 85 which also include a tail portion 86 with tapered skirt 87 extending rearwardly from a transverse wall 88 similarly to the main body 81, as depicted in FIG. 16. When assembled together in a barrel (not shown) and subject to an axial in-barrel load, the wedging action on the tapered skirt portion effectively seals the respective tail portions against the barrel bore, as described in the applicant's earlier International Applications.

Figure 17:
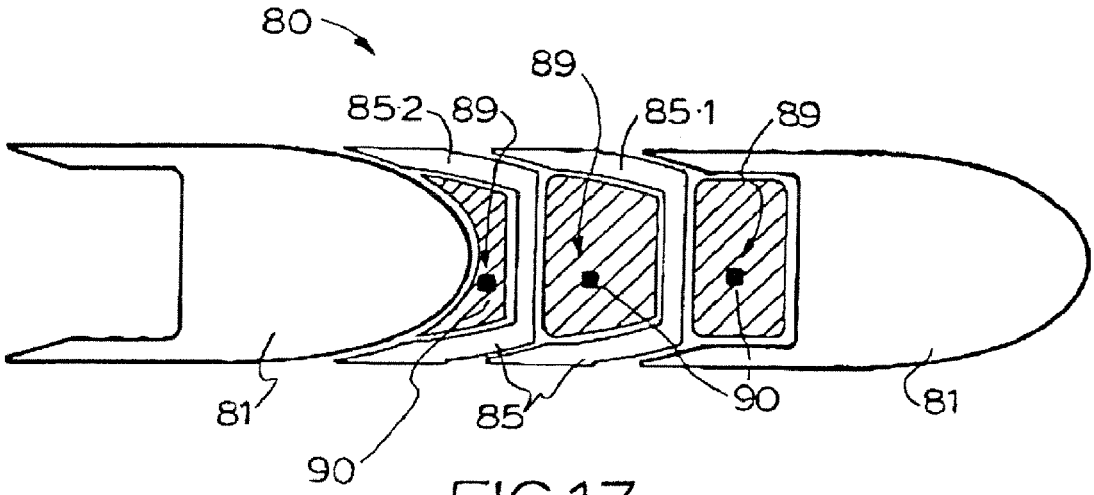

With reference to FIG. 17, it will be seen that the assembled main projectile 81 and cooperating cup members 85.1, 85.2 effectively from a cavity that is divided by wall members formed by transverse walls 88 of the propellant cups. Thus by provision of coded firing signals to the initiators 90 disposed with the respective propellant charges 89, one, two or all three charges may be simultaneously fired to achieve a desired muzzle velocity.

Figure 18:
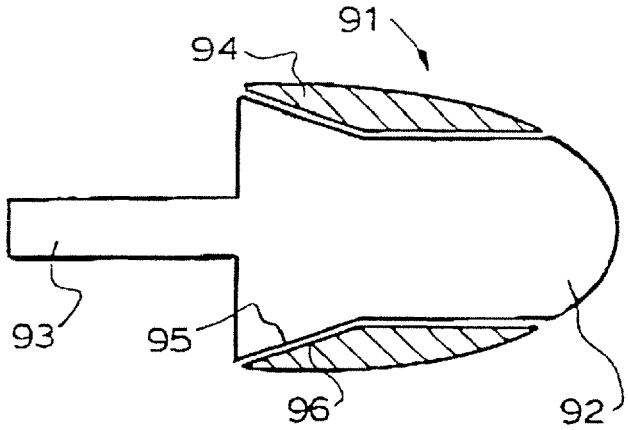
FIGS. 18, 19 and 20 depict a projectile assembly of another embodiment of the present invention.
Figure 19:
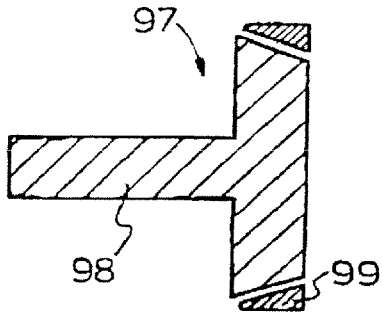
Figure 20:
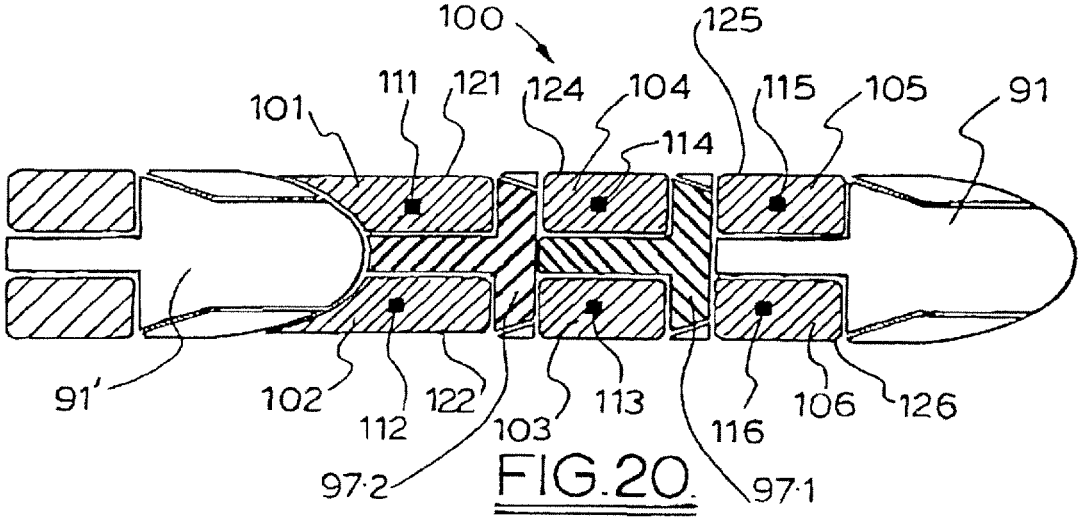

A further embodiment of the invention is depicted in FIGS. 18, 19 and 20, wherein the main projectile body 91 is of the type including a head portion 92 with rearwardly extending central spine 93 and a band or collar 94 disposed on the head portion 92 of the projectile body 91, wherein the collar and head portion include complementary tapered surfaces 95, 96. An auxiliary projectile body 97 also includes a central spine 98 and a similarly configured collar member 99. In both cases, the collar members are arranged to provide an operative seal with the bore of a barrel (not shown).

With particular reference to FIG. 20, it will be appreciated that individual propellant charges 101, 102, 103, 104, 105 and 106 may be selectively simultaneously ignited by receipt of firing signals by respective initiators 111, 112, 113, 114, 115 and 116. In the present embodiment, each initiator is integrated with a receiving means that can receive the firing signals directly from a signal transmitting coil disposed in the barrel (not shown), thus obviating the requirement for secondary receiving coils.

Further, the embodiment illustrates how different propellant charge separating means may be employed together in a projectile assembly, in that a given pair of charges 103-104 is separated from other pairs 101-102 and 105-106 by transverse walls of the auxiliary projectiles 97.1, 97.2, whilst individual charges within the pair may be separated by respective enclosures in the form of non-metallic bags 121, 122, 123, 124, 125 and 126.

In the embodiments discussed above, it will be appreciated that any propellant charges remaining in the barrel after firing a particular projectile may be cleared from the barrel by separate initiation, prior to firing the next projectile in the stack of projectiles.

Furthermore, it is envisaged that the propellant division and selective initiation arrangement of the present invention may be used within many of the present applicant's other earlier projectile designs and barrel assembly configurations. Put more simply, there are existing designs and configurations not mentioned here that could use the method outlined above of separate smaller propellant loads and coded SCBs (or other ignition method) to achieve an electronically selectable range variable projectile.

Figure 13:
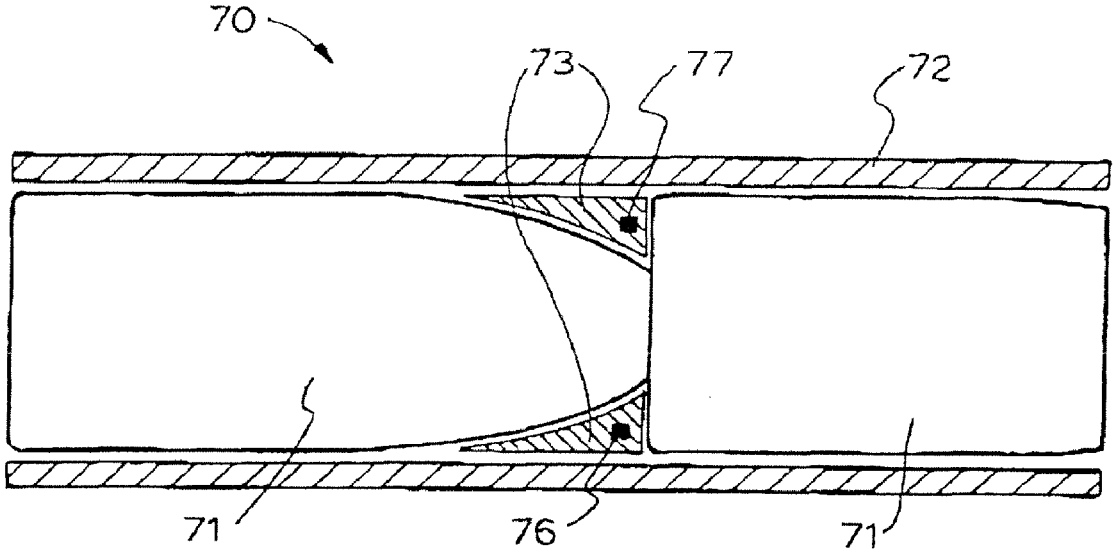
FIG. 13 is a sectional side elevational view of a projectile of a embodiment of the present invention.
Figure 14:
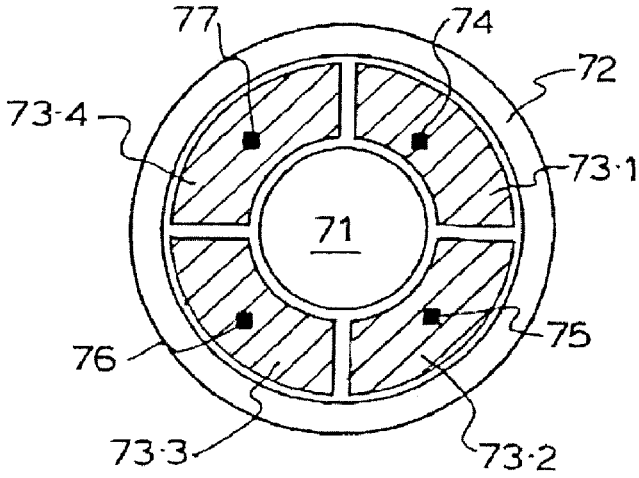
FIG. 14 is a sectional end elevational view of the projectile of the embodiment.

For example in the barrel assembly 70 of FIG. 13, with projectiles 71 axially stacked with a barrel 72 as illustrated in sectional side elevation, the propellant charge 73 could be split into four loads 73.1, 73.2, 73.3, 73.4, using bags each containing a respective initiator 74, 75, 76, 77, as shown in FIG. 14.

With the addition of different coded SCBs to each bag and an induction coil pair (not shown) for each projectile we have a system similar to that of above. It is to be taken that the present invention is applicable to alternative configurations of projectile and barrel assemblies (not explicitly mentioned here), including but not necessarily limited to those of the applicant, which are to be considered within the ambit of this patent application.

It is to be understood that the above embodiments have been provided only by way of exemplification of this invention, and that further modifications and improvements thereto, as would be apparent to persons skilled in the relevant art, are deemed to fall within the broad scope and ambit of the present invention described above.

What is claimed is:

1. A stackable projectile for use in a barrel together with a plurality of stacked projectiles, the projectile comprising:

a projectile body having a forward end and a rearward end, a component removably retained in the projectile body, the component including a cavity containing a propellant charge, an electric initiator at a forward end of the cavity, an inductive element connected to the electric initiator, wherein the cavity opens rearwards through an aperture for release of propulsion gases from the cavity rearwards into the barrel when the electric initiator ignites the propellant to fire the projectile from the barrel, a seal disc, wherein the sealing disc is opened by ignition of the propellant within the cavity and includes an edge surface for sealing contact with an interior wall in the cavity for sealing the propellant charge in the cavity, the edge surface and the interior wall include profiles wherein force applied to the disc external to the cavity forces the disc further into sealing contact with the interior wall, and a resisting component rearwards of the seal for, after the seal is opened, containing the seal within the projectile, wherein the seal is carried from the barrel by the projectile after ignition of the propellant.

2. A projectile according to claim 1 wherein the resisting component includes two or more inwardly extending fingers in the aperture.

3. A projectile according to claim 1 further comprising multiple propellant charges in the cavity, each charge including a seal disc.

4. A projectile according to claim 1 wherein the seal disc is a moveable wall member.

5. A projectile according to claim 1 wherein the seal disc and interior wall profiles are tapers.

6. A projectile according to claim 1 wherein the seal disc is a rupturable disc.

7. A projectile according to claim 1 wherein the electric initiator initiates on receiving a particular type or intensity of firing signal current.

8. A projectile according to claim 1 further comprising a decoder for receiving a signal from the inductive element for initiating the propellant.

9. A projectile according to claim 1 wherein the inductive element is a coil.

10. A projectile according to claim 1 wherein the initiator comprises a semi conductor bridge.

11. A projectile according to claim 1 wherein edge surface of the seal disc is held in sealing contact with the interior wall of the cavity by the resisting component and wherein the force applied to the disc by the propellant gases external to the cavity forces the disc into further sealing contact with the interior wall.

12. A projectile according to claim 1 wherein the forward end includes a nose portion and the rearward end includes a tail portion, and wherein the nose portion is shaped to fit the tail of a leading projectile when the projectile is stacked in a barrel.

13. A projectile according to claim 12 wherein a surface of the nose portion is convex.

14. A projectile according to claim 13 wherein a corresponding surface of the tail portion is concave.

15. A projectile according to claim 12 wherein the tail portion includes a rim for contacting the body of a trailing projectile.

* * * * *